US011142875B2

(12) United States Patent
Lightfoot

(10) Patent No.: US 11,142,875 B2
(45) Date of Patent: Oct. 12, 2021

(54) VIBRATING FLOAT TOOL

(71) Applicant: John Wade Lightfoot, Medicine Hat (CA)

(72) Inventor: John Wade Lightfoot, Medicine Hat (CA)

( * ) Notice: Subject to any disclaimer, the term of this patent is extended or adjusted under 35 U.S.C. 154(b) by 67 days.

(21) Appl. No.: 16/720,450

(22) Filed: Dec. 19, 2019

(65) Prior Publication Data

US 2021/0189665 A1 Jun. 24, 2021

(51) Int. Cl.

| | |
|---|---|
| ***E01C 19/00*** | (2006.01) |
| ***E01C 19/38*** | (2006.01) |
| ***E01C 19/40*** | (2006.01) |
| ***E01C 19/32*** | (2006.01) |

(52) U.S. Cl.

CPC ..... *E01C 19/38* (2013.01); *E01C 19/32* (2013.01); *E01C 19/402* (2013.01)

(58) Field of Classification Search

CPC ..... E01C 19/32; E01C 19/38; E01C 19/402
USPC ..... 404/72, 75, 112, 113, 83; 15/235.8; 264/162

See application file for complete search history.

(56) References Cited

U.S. PATENT DOCUMENTS

| | | | | |
|---|---|---|---|---|
| 3,402,647 | A * | 9/1968 | Colizza | E04F 21/245 404/112 |
| 4,859,115 | A * | 8/1989 | Morrison | E04F 21/245 404/112 |
| 5,234,283 | A | 8/1993 | Adkins | |
| 6,200,065 | B1 | 3/2001 | Eitzen | |
| 6,379,080 | B1 | 4/2002 | Saffo, Sr. | |
| 6,923,595 | B1 | 8/2005 | Chek | |
| 7,059,801 | B2 * | 6/2006 | Snyder | E04F 21/247 404/112 |
| 7,114,876 | B1 * | 10/2006 | Allen | E04F 21/247 404/112 |
| 7,156,577 | B1 | 1/2007 | Rozinski | |
| 7,465,121 | B1 | 12/2008 | Hendricks et al. | |
| 8,439,600 | B2 | 5/2013 | Brening | |
| 10,326,331 | B2 * | 6/2019 | Mikowychok | E04F 21/242 |
| 10,443,195 | B2 * | 10/2019 | Contrino | E04G 21/10 |
| 10,822,816 | B2 * | 11/2020 | Coughlan | E04G 21/08 |
| 2005/0036837 | A1 * | 2/2005 | Marshall | B25F 5/00 404/114 |
| 2007/0201302 | A1 | 8/2007 | Lindley | |
| 2008/0050177 | A1 * | 2/2008 | Sager | E04F 21/242 404/112 |
| 2008/0104788 | A1 * | 5/2008 | Wothers | E04F 21/244 15/235.8 |

(Continued)

*Primary Examiner* — Raymond W Addie
(74) *Attorney, Agent, or Firm* — Stratford Group Ltd.

(57) ABSTRACT

A vibration float tool comprising a float pad, an enclosed vibrating component affixed to the top of the float pad, a switch affixed to a battery used for activating and deactivating the enclosed vibrating component, a handle affixed to a surface of the enclosed vibrating component and the battery is used for powering the enclosed vibrating component wherein the battery attached to the handle. A method of using the vibrating float tool to level and settle a semi-liquid construction substrate, comprising activating the enclosed vibrating component with the switch, applying the float pad of the vibrating float tool across the semi-liquid construction substrate, leveling the surface of the semi-liquid construction substrate and setting the semi-liquid construction substrate.

11 Claims, 2 Drawing Sheets

(56) References Cited

U.S. PATENT DOCUMENTS

| | | | | |
|---|---|---|---|---|
| 2009/0060627 | A1* | 3/2009 | Stubbs | E04F 21/08 401/266 |
| 2009/0314674 | A1* | 12/2009 | Sauerheber | B25H 3/021 206/373 |
| 2013/0022398 | A1* | 1/2013 | Ranaivoson | E04F 21/04 404/118 |
| 2017/0042568 | A1* | 2/2017 | Levy | A45D 26/0004 |
| 2018/0327981 | A1 | 11/2018 | Baratta et al. | |
| 2020/0072291 | A1* | 3/2020 | Pyle | F16D 1/108 |

* cited by examiner

VIBRATING FLOAT TOOL

FIELD OF THE INVENTION

The present disclosure relates to a tool for leveling and settling semi-liquid construction substrate, more specifically but not by way of limitation, a tool that can be set to vibrate and can be employed to level a semi-liquid construction substrate surface and accelerate settling of the semi-liquid construction substrate.

BACKGROUND

Finishing concrete and other semi-liquid construction substrates can be a difficult and time-consuming task. Extensive planning required to ensure the concrete does not set before the finishing has been completed. Current methods of concrete and other semi-liquid construction substrate surface finishing involve the use of trowels and floats. The addition of a vibrating component to the float and trowel allows for an improvement in mixture of the concrete and other semi-liquid construction substrates, a smooth finish and greater ease of use of the tool. Similar devices employ vibration members on the surface of the tool, employ the handle as the source of vibration and employ the joining member between the handle and surface of the float as the source of vibration. These systems above require one of a fuel source or direct connection to a power outlet which results in a bulky, heavy and potentially restrictive device.

U.S. No. 2005/0036837 A1 (Marshall) discloses a hand-held vibrating concrete float where the vibrating source is located on the body of the device and electrical components are contained within a removable handle on the device. Shortcomings include a battery contained within the handle that requires its removal from the device as well as disassembly of the handle in order to access the battery.

U.S. Pat. No. 7,465,121 B1 (Hendricks) discloses a hand-held vibrating hand trowel where the vibrating source and electrical components are contained within the handle of the device. Shortcomings for this invention include a charger contained within the handle that requires separate batteries to power the device, accessing the main battery requires disassembly of the handle, no mode is apparent for adjusting the speed and strength of vibration.

All references cited above are incorporated herein.

There is a need for a vibration float tool that enables a fast, clean, professional looking finishing that can be completed with ease.

BRIEF SUMMARY

It is the object of the present invention to provide a vibrating float tool.

In accordance with an aspect of the invention, there is provided a vibration float tool comprising a float pad, an enclosed vibrating component affixed to top of the float pad, a switch affixed to a battery used for activating and deactivating the enclosed vibrating component, a handle affixed to a surface of the enclosed vibrating component and the battery is used for powering the enclosed vibrating component wherein the battery attached to the handle.

Another aspect of the present invention is a method of using the vibrating float tool to level and settle a semi-liquid construction substrate, comprising activating the enclosed vibrating component with the switch, applying the float pad of the vibrating float tool across the semi-liquid construction substrate, leveling the surface of the semi-liquid construction substrate and setting the semi-liquid construction substrate.

Another aspect of the present invention is a vibration float tool kit for the leveling and finishing of semi-liquid construction substrate comprising a float pad, a set of clips, screws and brackets, an enclosed vibrating component affixed to the top of the float pad with the clips, a switch affixed to a battery where the battery clips into the handle and a handle affixed to the surface of the enclosed vibrating component with the screws and the brackets.

In accordance with an embodiment of the invention, the float pad is composed of magnesium, aluminum or wood.

In accordance with an embodiment of the invention, the switch is a push-button or toggle switch.

In accordance with an embodiment of the invention, the handle is extendable and retractable.

In accordance with an embodiment of the invention, the handle is removable.

In accordance with an embodiment of the invention, the battery is rechargeable.

In accordance with an embodiment of the invention, the battery is removable.

In accordance with an embodiment of the invention, the battery is an existing power tool battery pack.

In accordance with an embodiment of the invention, the switch is a push-button or toggle switch.

In accordance with an embodiment of the invention, the enclosed vibrating component is equipped with a rotary button which adjusts the speed of the vibration.

In accordance with an embodiment of the invention, the enclosed vibrating component is equipped with a rotary button which adjusts the strength of the vibration.

In accordance with an embodiment of the invention, the float pad is a replaceable element of the kit.

In accordance with an embodiment of the invention, the float pad is a replaceable and rechargeable element of the kit.

In accordance with an embodiment of the invention, the kit further comprising a set of instructions for assembly and use.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

The details of one or more embodiments of the subject matter of this specification are set forth in the accompanying drawings and the description below. Other features, aspects, and advantages of the subject matter will become apparent from the description, the drawings, and the claims.

Like reference numbers and designations in the various drawings indicate like elements.

Figure 1:
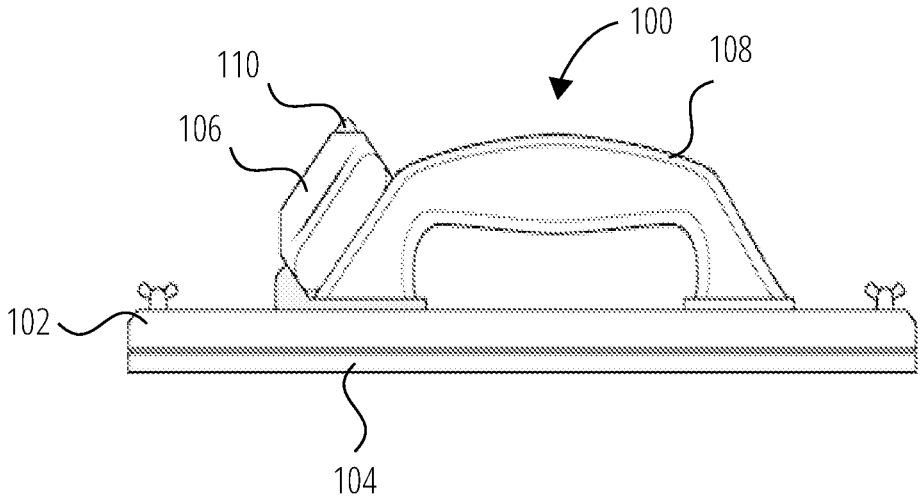
FIG. 1 illustrates a front profile 100 in accordance with one embodiment.

FIG. 1 depicts a front profile 100 of one embodiment of a vibrating float tool. An enclosed vibrating component 102 is shown affixed on top of a float pad 104. A handle 108 is shown affixed to the surface of the enclosed vibrating component 102 with an accompanying battery 106 shown attached to the handle 108. A switch 110 is visible on top of the battery 106. The float pad 104 is the point of contact with the concrete or any other semi-liquid construction substrate undergoing finishing. The enclosed vibrating component 102 is activated and deactivated via a switch 110. Embodiments of the switch 110 include, but are not limited to, a toggle switch and a push-button. Embodiments of the composition of the float pad 104 include, but are not limited to, magnesium, aluminum and wood. In another embodiment, the battery 106 is rechargeable. In another embodiment, the battery 106 is removable. In another embodiment, the battery is an existing power tool battery pack. In another embodiment, the enclosed vibrating component 102 is equipped with a rotary button which is capable of adjusting the speed of the vibration. In another embodiment, the enclosed vibrating component 102 is equipped with a rotary button which is capable of adjusting the strength of the vibration.

Figure 2:
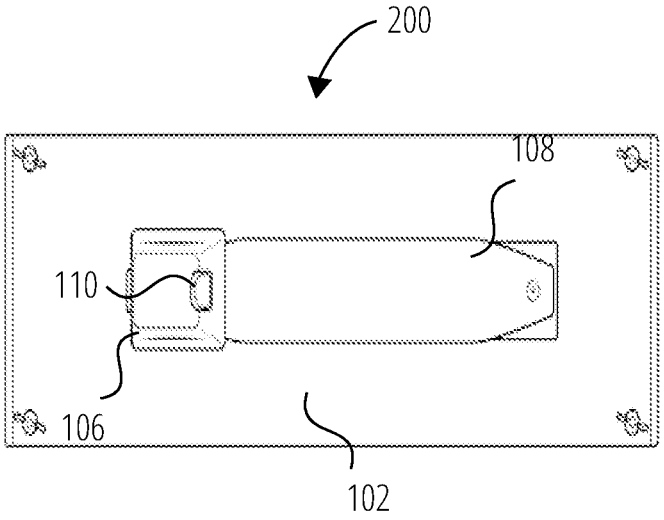
FIG. 2 illustrates a top profile 200 in accordance with one embodiment.

FIG. 2 depicts a top profile 200 of one embodiment of a vibrating float tool. The battery 106 is shown affixed to the handle 108, which are both affixed to the enclosed vibrating component 102. A switch 110 is present on the surface of the battery 106. The vibrating float tool may be employed to level and settle semi-liquid construction substrate by activating the switch 110 to power the enclosed vibrating component 102 and applying the vibrating float tool across the semi-liquid construction substrate until the substrate has become leveled and has settled. The addition of vibration at the point of application aids in the mixture of the semi-liquid construction substrate and helps to draw bubbles away from the substrate surface, vastly reducing effort required and accelerating the settling process. In another embodiment, the handle 108 is extendable and retractable to allow a user to cover a greater range of motion. In another embodiment, the handle 108 is removeable.

The foregoing descriptions of specific embodiments of the present invention have been presented for purposes of illustration and description. They are not intended to be exhaustive or to limit the invention and method of use to the precise forms disclosed. Obviously, many modifications and variations are possible in light of the above teaching. The embodiments described were chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient but is intended to cover the application or implementation without departing from the spirit or scope of the claims of the present invention.

What is claimed is:

1. A vibration float tool comprising:

a float pad;

an enclosed vibrating component affixed to top of said float pad;

a switch affixed to a battery used for activating and deactivating said enclosed vibrating component;

a rotary button for adjusting speed of said vibration or strength of said vibration;

a handle affixed to a surface of said enclosed vibrating component;

wherein said battery is used for powering said enclosed vibrating component; and said battery is attached to said handle.

2. The vibration float tool of claim 1 wherein said float pad is composed of magnesium.

3. The vibration float tool of claim 1 wherein said float pad is composed of aluminum.

4. The vibration float tool of claim 1 wherein said float pad is composed of wood.

5. The vibration float tool of claim 1 wherein said switch is a toggle switch.

6. The vibration float tool of claim 1 wherein said switch is a push-button.

7. The vibration float tool of claim 1 wherein said handle is removable.

8. The vibration float tool of claim 1 wherein said battery is rechargeable.

9. The vibration float tool of claim 1 wherein said battery is removable.

10. The vibration float tool of claim 1 wherein said battery is an existing power tool battery pack.

11. A method of using the vibrating float tool of claim 1, to level and settle a semi-liquid construction substrate, comprising:

activating said enclosed vibrating component with said switch;

applying said float pad of said vibrating float tool across said semi-liquid construction substrate;

leveling the surface of said semi-liquid construction substrate; and setting said semi-liquid construction substrate.

* * * * *